US006135675A

United States Patent [19]

Moreau

[11] Patent Number: 6,135,675

[45] Date of Patent: Oct. 24, 2000

[54] SHEETPILE SYSTEM INCLUDING FULL PLASTIC EXTERIOR

[75] Inventor: Jeffrey M. Moreau, Kennesaw, Ga.

[73] Assignee: Northstar Vinyl Products LLC, Kennesaw, Ga.

[21] Appl. No.: 09/216,139

[22] Filed: Dec. 18, 1998

[51] Int. Cl.[7] ..... F02D 29/02

[52] U.S. Cl. ..... 405/284; 405/285

[58] Field of Search ..... 405/211, 211.1, 405/216, 274, 284, 285

[56] References Cited

U.S. PATENT DOCUMENTS

| | | | |
|---|---|---|---|
| 884,270 | 4/1908 | Fiero . | |
| 999,334 | 8/1911 | Pearson . | |
| 1,076,021 | 10/1913 | Conkling . | |
| 1,855,113 | 4/1932 | Nolte . | |
| 2,189,804 | 2/1940 | Knight . | |
| 4,019,301 | 4/1977 | Fox | 405/216 |
| 4,674,921 | 6/1987 | Berger | 405/284 |
| 4,690,588 | 9/1987 | Berger . | |
| 4,716,210 | 12/1987 | Trummelmeyer et al. | 528/75 |
| 4,721,418 | 1/1988 | Queen | 405/284 |
| 4,743,142 | 5/1988 | Shiraishi et al. | 405/216 |
| 4,818,148 | 4/1989 | Takeda et al. | 405/216 |
| 4,917,543 | 4/1990 | Cole et al. | 405/279 |
| 5,145,287 | 9/1992 | Hooper et al. . | |
| 5,360,295 | 11/1994 | Isacksen . | |
| 5,580,191 | 12/1996 | Egan | 405/284 |

FOREIGN PATENT DOCUMENTS

| | | |
|---|---|---|
| 347681 | 1/1922 | Germany . |
| 616065 | 7/1935 | Germany . |

*Primary Examiner*—Eileen D. Lillis
*Assistant Examiner*—Frederick L. Lagman
*Attorney, Agent, or Firm*—Jones & Askew, LLP

[57] ABSTRACT

A marine sheetpile system and method for providing same includes the use of plastic-coated wood wales and wood piles in conjunction with plastic sheetpile sections to provide a sheetpile configuration which is resistant to wood having and other undesirable animals or environments.

16 Claims, 2 Drawing Sheets

SHEETPILE SYSTEM INCLUDING FULL PLASTIC EXTERIOR

REFERENCE TO PRIOR APPLICATION

This application claims full priority and incorporates by reference pending provisional U.S. patent application Ser. No. 60/068,204, filed Dec. 19, 1997. This application also claims full priority and incorporates by reference pending U.S. patent application Ser. No. 09/159,218, filed Sep. 23, 1998 now abandoned.

TECHNICAL FIELD

The present invention relates generally to plastic coatings, and particularly relates to the application of plastic to wooden elements of a marine sheetpile system, in order to provide a marine sheetpile system which is resistant to damage by insect attach or other environmental hazards.

BACKGROUND OF THE INVENTION

Marine sheetpile systems including synthetics are known in the art. Examples of such sheetpile systems are shown in U.S. Pat. Nos. 4,690,588 and 5,145,287. Although some of such sheetpile systems are adequate for certain situations, needs for improvement still exists. For example, there are problems inherent in such systems with respect to infestation of the wood elements by "wood borers" and other organisms. As the main structural elements (namely the posts and wales, discussed in more detail below) are composed of wood, significant damage potentially exists. Therefore a need in the art exists for a marine sheetpile system which includes sufficient structural capabilities, yet includes resistance to attack by insects and other elements.

Some prior art configurations have attempted to overcome the problems of wood deterioration by using plastic and/or other synthetics for providing pilings or wales. An example is a known synthetic pile configuration provided by Seaward International of Virginia, under the name of "SEAPILE". These synthetic pile configurations are composed of polyethylene with internal fiberglass reinforcing bars running along their length. Although these configurations do not include wood which can deteriorate, they tend to be quite expensive and for that reason have not found common usage.

Therefore there is a need for a marine sheetpile system which includes sufficient structural capabilities, includes resistance to attack by insects and other elements, yet is comparable in cost to existing sheetpile systems which include wood piles and wales.

SUMMARY OF THE INVENTION

In summary, the present invention relates to the use of a spraying process which provides a plastic coating on a wood substrate, which results in a provision of a sheetpile system comprised of elements which are either completely composed of plastic (the sheetpile sections), or are coated with plastic (horizontal wales and vertical piles). Such a marine sheetpile system includes sufficient structural capabilities, includes resistance to attack by insects and other elements, yet is comparable in cost to existing sheetpile systems which include wood piles and wales, due to the continued use of wood as the main structural component in the piles and wales.

DETAILED DESCRIPTION OF THE PREFERRED EMBODIMENT

Reference is now made to the drawings, in which like numerals illustrate like elements throughout the several views.

The Overall Spraying Concept

The above plastic application process may be applied to many various types of wood. However, one particular type of wood which can accept such a plastic covering is wood in a marine sheetpile configuration.

In such as configuration, polyurethane may be applied to wood in a marine environment, including wales and piles of a marine sheetpile system, in order to provide protection from marine borers and other animals.

The sheetpile system is typically tied back to earth anchors via tie rods as known in the art.

The Sheetpile System Generally

Figure 1:
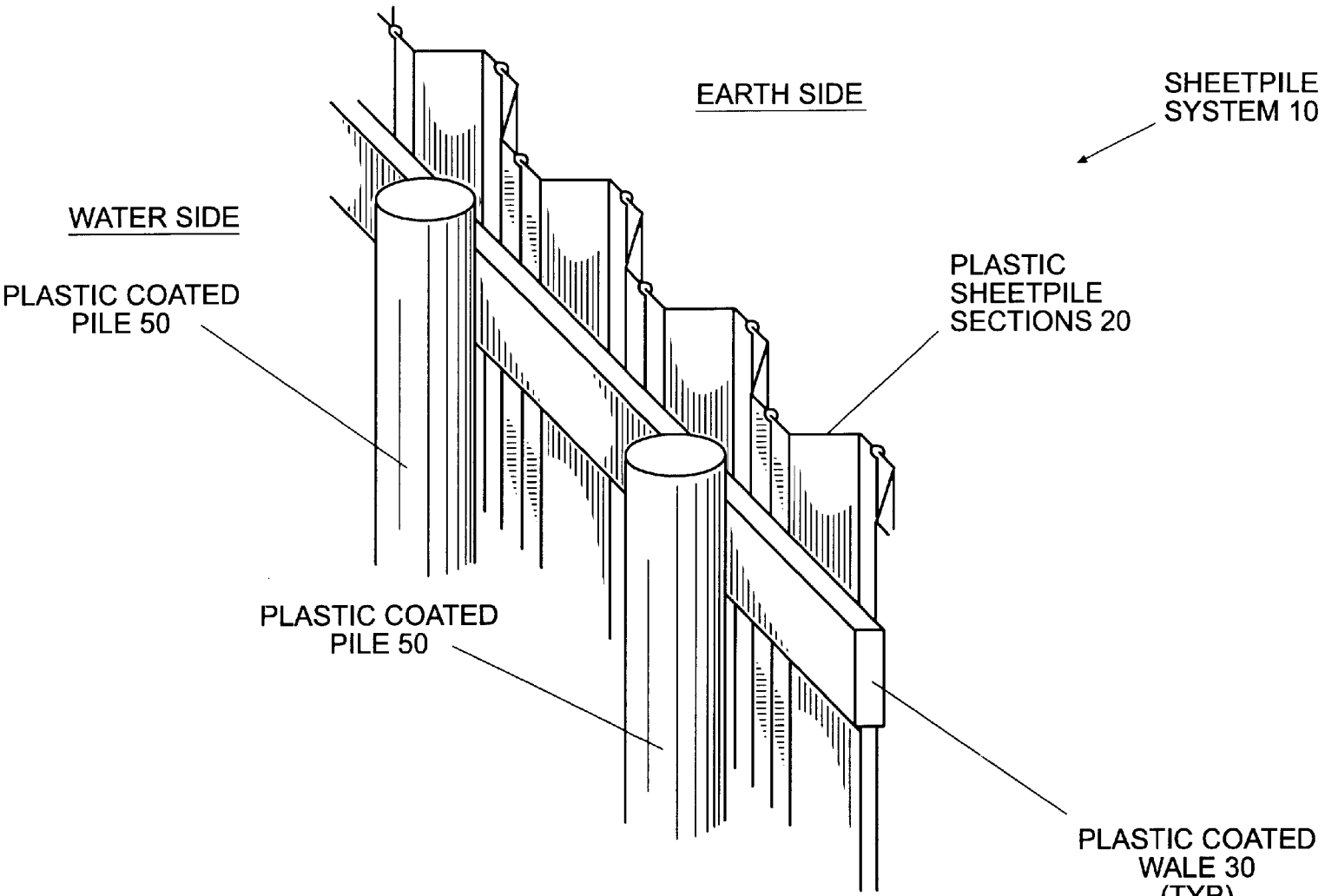
FIG. 1 is a pictorial view of a section of a fully plastic protected sheetpile system 10, including plastic sheetpile sections 20, plastic coated horizontal wales 30 (only one of which is shown), and plastic coated vertical piles 50 (only two of which are shown).
Figure 2:
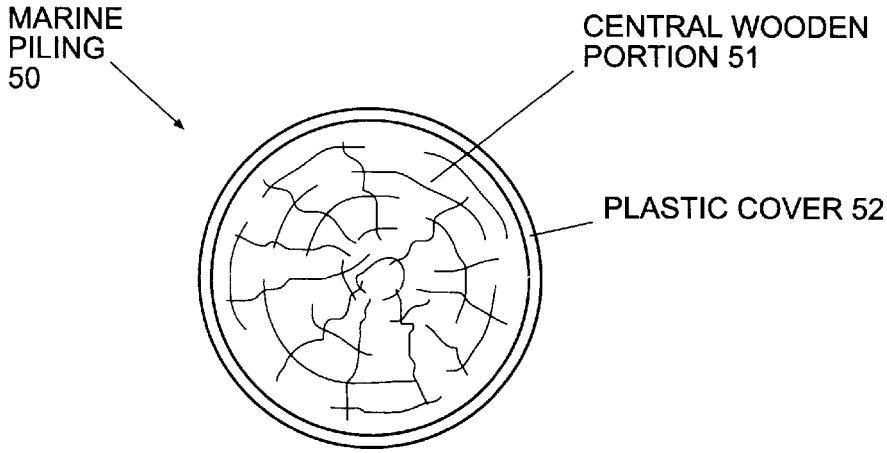
FIG. 2 is a transverse cross-sectional view of a plastic coated vertical pile 50, illustrating the interior wood portion 41 and the exterior coating or cover 52. It should be understood that the coated vertical piles 50 not only have a coating about their periphery as shown in FIG. 2, but on the upper, typically air-exposed, end face of the piles 50.

Reference is first made to FIG. 1, which is a pictorial view of a section of a fully plastic protected sheetpile system 10, including plastic sheetpile sections 20, plastic coated horizontal wales 30 (only one of which is shown), and plastic coated vertical piles 50 (only two of which are shown).

The plastic sheetpile sections 20 can interlock to provide a substantially continuous retaining wall as known in the art. The plastic sheetpile sections 20 can be maintained in place by a plurality of plastic coated horizontal wales 30 (only one of which is shown) which extend across the front (water side) of the interlocked plastic sheetpile sections 20 to hold them back.

These plastic coated horizontal wales 30 are themselves sometimes held back in place by a plurality of plastic coated vertical piles 50 (only two of which are shown) which are substantially vertical and have their lower ends buried in submerged earth.

A novel concept developed by the inventor includes the application of plastic such as polyurethane to the exterior surfaces both the horizontal wales 30 and the vertical piles 50. This provides a marine sheetpile system which has elements either composed of plastic (the sheetpiles) or covered with plastic (the wales and posts). This configuration is believed to include many advantages, including resistance to insect damage.

Figure 3:
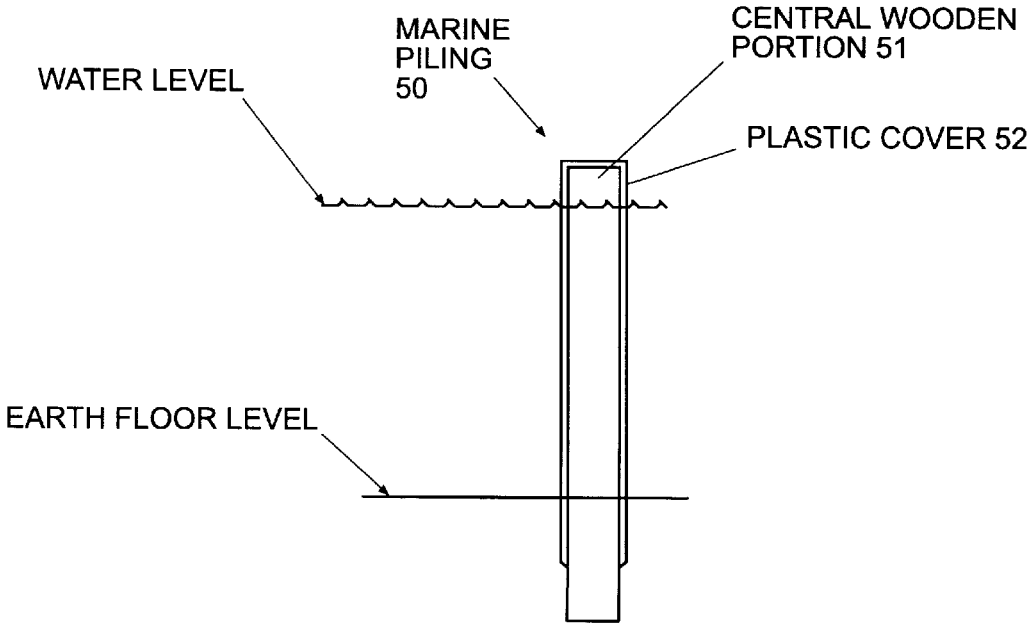
FIG. 3 is a side elevational view of a plastic covered vertical piling 50, illustrating how the partial plastic coating of the piling 50 is applied such that it extends below ground level. In this configuration, the plastic coating is not applied to one end of the piles, such that plastic is not wasted on the lengths of piles which are embedded in the earth.

In one preferred embodiment, the horizontal wales 30 (which have a rectangular transverse cross section) are preferably completely coated on all sides with the plastic. The piles 50 are covered with plastic only where exposure has been perceived as sufficient to justify plastic coating. Such exposure has been seen to be insignificant for the lower pile portions which are buried in earth, as shown in FIG. 3. As such, in order to save plastic coating expense it is contemplated to cover at least the portion of the pilings which extend above the submerged supporting earth. To be on the safe side, it is thought that some extra coating should be applied such that some plastic coating is submerged in earth.

Plastic Selection

The process of applying a plastic coating to a wood substrate begins with the proper selection of a chemical compound as well as the proper selection of wood material.

Polyurethane has been found acceptable for this application. Since our application will require the treatment of a moist material, the goal becomes one of striking the balance between the urea content in a polyurethane compound and a moisture content in the wood that can be met practically and consistently on a widespread basis.

Urea, a chemical additive, is sometimes added to polyurethane because it is "moisture friendly", and will allow polyurethane to adhere to a moist substrate. However, urea, in large quantities, is not light stable and will sacrifice long term performance if too much of the chemical is added to the compound.

Polyurethane can be applied either cold or hot. A cold application to the wood results in a tight fitting seal, however, it is not permanently attached to wood (i.e. it will peel the coating off of the wood with a little effort). On the other hand, a hot application results in a permanent bond, which allows the coating to withstand heavy impact (i.e. it will not as easily rip if an object such as a boat collides with it).

A permanent bond is also beneficial in shipping as the finished product will be handled with heavy equipment.

Substrate Selection

Wood including pressure treated wood is the substrate which will be used, for both pilings and wales.

Pure polyurethane chemical reacts unfavorably with the H2O molecule. Therefore, the substrate that the chemical is being applied to must be as dry as possible or the chemical will not adhere to the substrate.

However, to specify in the manufacturing process that wood must be completely dry would be impractical. In addition, since the finished product will be used in marine applications, the wood is typically pressure treated prior to the application of the plastic coating. This pressure treating process tends to leave the wood wet.

At the time of this writing, we have found that a moisture content of 20–30% is acceptable, based on the poly-urea blend that we are using. The board can be treated with CCA levels of up to 2.5 lbs. per cubic board foot.

However, it is contemplated to increase the urea content and experiment on damper lumber. If we can consistently treat damper wood, we will become more efficient, not having to wait for wood to dry before treating it. In addition, future sites that will be set up for treating will benefit from the "moisture tolerant" compound.

Reference is also made to pending U.S. patent application Ser. No. 09/159,218, filed Sep. 23, 1998, now abandoned for further discussion of spraying techniques and mixes which may be used.

Substrate Preparation

In order for the poly compound to form a tight consistent bond, the board must be properly prepared. The process begins with properly cleaning the board, freeing the substrate from dust left from the milling process. On an automated line, this cleaning will be done on the front of the line using a series of brushes and air lines. In a manual application, the boards will be cleaned with air.

The Initial "Dusting" Coat

To begin the application of the base thickness, the poly compounds should be heated to 140° F. The compound is applied using a plural component sprayer.

The application process begins by "dusting" the wood substrate with a light coating of poly compound, being sure to leave bare areas of wood. This is an important part of the invention as this will allow pent-up moisture within the wood member to escape. (Otherwise, moisture, which is not allowed to escape, will form an undesirable blister under the poly compound).

The dusting step should be continued until the entire wood substrate is coated lightly. (The automated line will be designed to do this as the board travels through a spray booth).

Post-Dusting Inspection

Once a base has been applied, the wood substrate should be inspected for blisters that may have formed. Piles or wales with blisters should be discarded or reprocessed. Otherwise, the next step of building mil thickness is taken.

Final Mil Thickness Application

In order to apply the full mil thickness, one should allow the capacity of the plural component sprayer to operate at full capacity to bring the mil thickness of the coating up to specification. The mil thickness should be allowed to cool for approximately 45 seconds before handling.

Patching of Damaged or Otherwise Disturbed Coating

The above description is the initial "virgin" treating process in a nutshell. However it should also be understood that a "field patch kit" is also contemplated under the present invention to allow contractors to patch up cuts and holes that they make to the wood substrate. The patch kit essentially allows the contractors to "re-seal" cuts that they've made.

Advantages

One chief benefit of the spray process is that the manufacturer is not restricted to the dimension of board that he can coat. Any size board can be coated since the coating is not an extruded or molded part. In one prior art configuration shown in U.S. Pat. No. 5,360,295, a specific size plastic sleeve is extruded and must be used on a specific sized counterpart board.

The other advantages relate to the obvious advantage of including plastic as a shield to undesirable animals or weather conditions.

Conclusion

This invention has been described in specific detail with reference to the disclosed embodiments, it will be understood that many variations and modifications may be effected within the spirit and scope of the invention as described in the appended claims.

What is claimed is:

1. A retaining wall sheetpile system, said system comprising;

elongate plastic sheetpile sections;

plastic coated horizontal pressure treated wood wales for supporting said sheetpile sections; and plastic coated substantially vertical pressure treated wood piles for supporting said wales and said sheetpile sections, said vertical piles being configured for partial burial within supporting earth.

2. The retaining wall sheetpile system of claim 1, wherein at least one of said plastic coated substantially vertical piles is partially coated with said plastic along a length of said pile which is to be exposed to water or air and which will not be buried in the ground, but said one of said plastic coated substantially vertical piles include a portion which is uncoated and is buried in the ground.

3. The retaining wall sheetpile system of claim 2, wherein said plastic coated horizontal pressure treated wood wales are substantially completely coated with plastic.

4. The retaining wall sheetpile system of claim 1, wherein said plastic coated horizontal pressure treated wood wales are substantially completely coated with plastic.

5. A retaining wall sheetpile system, said system comprising;

elongate plastic sheetpile sections; and plastic coated horizontal pressure treated wood wales for supporting said sheetpile sections.

6. The retaining wall sheetpile system of claim 5, wherein said plastic coated horizontal pressure treated wood wales are substantially completely coated with plastic.

7. A retaining wall sheetpile system, said system comprising;

elongate plastic sheetpile sections;

horizontal pressure treated wood wales for supporting said sheetpile sections; and plastic coated substantially vertical pressure treated wood piles for supporting said wales and said sheetpile sections, said vertical piles being configured for partial burial within supporting earth.

8. The retaining wall sheetpile system of claim 7, wherein at least one of said plastic coated substantially vertical piles is partially coated along a length of said pile which is to be exposed to water or air and which will not be buried in the ground, but said one of said plastic coated substantially vertical piles include a portion which is uncoated and is buried in the ground.

9. A method of providing a sheetpile system said method including the steps of:

providing plastic sheetpiles, pressure treated wooden wales, and pressure treated wooden piles:

spraying at least a portion of said pressure treated wooden wales with plastic, said spraying being done at least initially in separate "dusting" stages to allow pent-up moisture in the wood to escape;

spraying at least a portion of said pressure treated wooden piles with plastic; and using said plastic coated pressure treated wooden wales and pressure treated wooden piles in conjunction with said plastic sheetpile sections to provide said sheetpile system.

10. The method of providing a sheetpile system of claim 9, wherein at least one of said plastic coated substantially vertical pressure treated wooden piles is partially coated along a length of said pile which is to be exposed to water or air and which will not be buried in the ground.

11. The method of providing a sheetpile system of claim 10, wherein said plastic coated horizontal pressure treated wooden wales are substantially completely coated with plastic.

12. The method of providing a sheetpile system of claim 10, wherein said plastic coated pressure treated wooden horizontal wales are substantially completely coated with plastic.

13. A method of providing a sheetpile system including plastic sheetpile, wooden wales, and wooden piles, said method including the steps of:

spraying at least a portion of said pressure treated wooden wales with plastic, said spraying being done in separate "dusting" stages to allow pent-up moisture in the wood to escape; and using said plastic coated wales and piles in conjunction with plastic sheetpile sections.

14. The method of providing a sheetpile system of claim 13, wherein said plastic coated horizontal wales are substantially completely coated with plastic.

15. A retaining wall sheetpile system, said system comprising;

elongate plastic sheetpile sections;

horizontal pressure treated wood wales for supporting said sheetpile sections; and plastic coated substantially vertical pressure treated wood piles for supporting said wales and said sheetpile sections, said vertical piles being configured for partial burial within supporting earth.

16. The sheetpile system of claim 15, wherein at least one of said plastic coated substantially vertical pressure treated wood piles is partially coated along a length of said pile which is to be exposed to water or air and which will not be buried in the ground.

* * * * *

UNITED STATES PATENT AND TRADEMARK OFFICE

CERTIFICATE OF CORRECTION

PATENT NO. : 6,135,675
DATED : October 24, 2000
INVENTOR(S) : Moreau

It is certified that error appears in the above-identified patent and that said Letters Patent is hereby corrected as shown below:

Title page,
Add, -- [60] Related U.S. Application Data,
Provisional Application No. 60/068,204, Dec. 19, 1997, and continuation-in-part of 09/159,218, filed Sept. 23, 1998. --

Signed and Sealed this

Eighteenth Day of February, 2003

JAMES E. ROGAN
*Director of the United States Patent and Trademark Office*

US006135675C1

(12) EX PARTE REEXAMINATION CERTIFICATE (5961st)

United States Patent

Moreau

(10) Number: US 6,135,675 C1

(45) Certificate Issued: Oct. 23, 2007

(54) SHEETPILE SYSTEM INCLUDING FULL PLASTIC EXTERIOR

(75) Inventor: Jeffrey M. Moreau, Kennesaw, GA (US)

(73) Assignee: Northstar Vinyl Products LLC, Kennesaw, GA (US)

Reexamination Request:
No. 90/006,640, May 16, 2003

Reexamination Certificate for:

| | |
|---|---|
| Patent No.: | **6,135,675** |
| Issued: | **Oct. 24, 2000** |
| Appl. No.: | **09/216,139** |
| Filed: | **Dec. 18, 1998** |

Certificate of Correction issued Feb. 18, 2003.

Related U.S. Application Data

(63) Continuation-in-part of application No. 09/159,218, filed on Sep. 23, 1998.

(60) Provisional application No. 60/068,204, filed on Dec. 19, 1997.

(51) Int. Cl.
*E02D 29/02* (2006.01)

(52) U.S. Cl. ..... 405/284; 405/285

(58) Field of Classification Search ..... None
See application file for complete search history.

(56) References Cited

U.S. PATENT DOCUMENTS

| | | | | |
|---|---|---|---|---|
| 2,993,808 A | | 7/1961 | Thornberry | 428/480 |
| 3,903,031 A | | 9/1975 | Matsuda et al. | 260/29.3 TN |
| 3,903,032 A | | 9/1975 | Matsuda et al. | 260/29.2 TN |
| 3,928,271 A | | 12/1975 | Matsuda et al. | 260/29.2 TN |
| 4,716,210 A | | 12/1987 | Trümmelmeyer et al. | 528/75 |
| 4,917,543 A | | 4/1990 | Cole et al. | 405/262 |
| 5,252,212 A | | 10/1993 | McHugh et al. | 210/490 |
| 5,360,295 A | | 11/1994 | Isacksen | 405/284 |
| 5,811,483 A | * | 9/1998 | Close | 524/500 |
| 6,135,675 A | * | 10/2000 | Moreau | 405/284 |

OTHER PUBLICATIONS

"The First Choice" brochure, 1997.
"Build It Better" brochure, 1998.
Hannu Viitanen, "Preservation of Wooden Boards", Tutkimuksia, Valtion Teknillinen Tutkimuskeskus, 1984 (hereinafter "Viitanen").
Bruce R. Johnson, "Protection of Timber Bulkheads from Marine Borers", Timber Bulkheads, 1987 (hereinafter "Johnson").
"Protect Your Piling With Pile Wrap™" brochure, 1991 (hereinafter "Pile Wrap™" brochure).
A. A. W. Baecker, "A Non–toxic Method to Combat Incipient Decay of CCA– and Creasote–Treated Poles in Soil–Contact", International Biodeterioration & Biodegradation, 1993 (hereinafter "Baecker").
"Marine Construction Manual"booklet, 1993.
"CCS™ Coating, Marine Structures—Epoxy Coating For Concrete And Steel Marine Structures" publication, 1995 (hereinafter "CCS™Coating" publication).
"Modern Paint and Coatings" publication, 1996.

* cited by examiner

*Primary Examiner*—Jeffrey R. Jastrzab

(57) ABSTRACT

A marine sheetpile system and method for providing same includes the use of plastic-coated wood wales and wood piles in conjunction with plastic sheetpile sections to provide a sheetpile configuration which is resistant to wood having and other undesirable animals or environments.

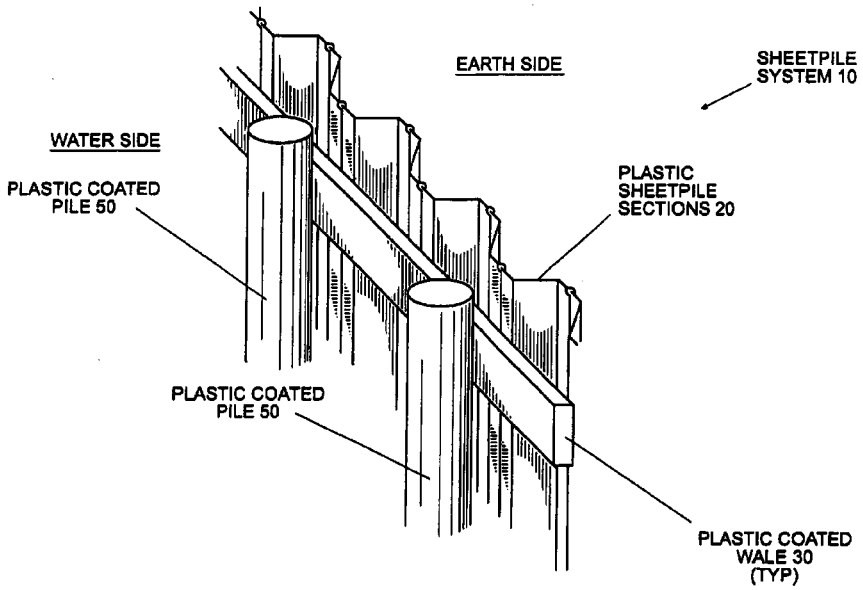

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9, 10, 11, 13 and 14 is confirmed.

Claims 1–8, 12, 15 and 16 are cancelled.

* * * * *